US006279537B1

(12) United States Patent
Yonekura et al.

(10) Patent No.: US 6,279,537 B1
(45) Date of Patent: Aug. 28, 2001

(54) AIR FUEL RATIO CONTROL APPARATUS FOR AN INTERNAL COMBUSTION ENGINE

(75) Inventors: Tosiaki Yonekura, Hyogo; Hideaki Katashiba, Tokyo; Satoshi Wachi, Tokyo; Hirofumi Ohuchi, Tokyo, all of (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/456,504

(22) Filed: Dec. 8, 1999

(30) Foreign Application Priority Data

Jun. 7, 1999 (JP) ..... 11-159787

(51) Int. Cl.[7] ..... F02D 43/04

(52) U.S. Cl. ..... 123/406.48; 701/105; 701/108; 701/109

(58) Field of Search ..... 123/406.48, 698, 123/406.45, 406.46, 406.47; 701/108, 109, 105

(56) References Cited

U.S. PATENT DOCUMENTS 4,878,473 * 11/1989 Nakaniwa et al. ..... 123/691
4,915,080 * 4/1990 Nakaniwa et al. ..... 123/691

FOREIGN PATENT DOCUMENTS 926 327 6/1999 (EP) .
940 570 9/1999 (EP) .
7-305644 11/1995 (JP) ..... F02D/41/04

* cited by examiner

*Primary Examiner*—Andrew M. Dolinar
(74) *Attorney, Agent, or Firm*—Sughrue, Mion, Zinn Macpeak & Seas, PLLC

(57) ABSTRACT

In order to improve estimation accuracy of estimating the value of the NOx exhaust concentration, the air fuel ratio control apparatus is adapted to estimate the NOx exhaust concentration from at least either one of a value depending on the air fuel ratio or a value depending on the exhaust gas recirculation quantity and a value depending to the ignition timing by means of the ECU 230.

12 Claims, 7 Drawing Sheets

AIR FUEL RATIO CONTROL APPARATUS FOR AN INTERNAL COMBUSTION ENGINE

BACKGROUND OF THE INVENTION

1. Field of the Invention

The present invention relates to an air fuel ratio control apparatus for an internal combustion engine with a use of a NOx catalyst.

2. Description of the Prior Art

FIG. 8 is a schematic diagram showing a conventional air fuel ratio control apparatus for an internal combustion engine and the combustion chamber 15 as well as the air intake system and the ignition system are designed to allow the lean combustion. The air intake port 2 of an internal combustion engine 1 is connected, through a manifold 4 with a fuel injection valve 3 attached to each cylinder, with an air intake pipe which comprises an air cleaner 5, an air flow sensor 6 for detecting air intake quantity Qa, throttle valve 7 and ISC valve 8. The air flow sensor, which is of a type such as the Karman's vortex, is preferably used. The exhaust pipe 14, to which the air fuel ratio sensor 12 such as a linear fuel ratio sensor 12 such as a linear air fuel ratio sensor 12 as a means for detecting the excess air ratio λ (air fuel ratio information) is disposed, is connected to the exhaust port of the internal combustion engine 1 through the exhaust manifold 11.

The exhaust gas purification catalyst device 13 comprises two catalyst of a ternary catalyst 13 and a occlusion catalyst 13*b*, and the ternary catalyst 13*a* is disposed on the more upstream side of the occlusion catalyst 13*b*. The ternary catalyst 13*a* has a function of oxidization of HC (hydrocarbon) and CO (carbon monoxide) as well as of reduction of NOx. Reduction of the NOx by means of the ternary catalyst 13 is promoted utmost with the theoretical air fuel ratio being in the vicinity of 14.7. The NOx occlusion catalyst 13*b* has a function of occluding the NOx at an excessively rich Oxygen atmosphere (lean air fuel ratio) and of reducing the NOx at the oxygen deficient atmosphere (rich air fuel ratio) with existence of HC and CO. As the NOx occlusion catalyst 13*b*, a catalyst consisting of the alkali earth metals such as Ca (calcium) and Ba (barium) and Pt (platinum) is used. A catalyst, which performs reduction of NOx exhausted to the atmosphere by utilizing a characteristics of adsorbing the NOx exhausted from the internal combustion engine 1 at an excessively rich oxygen state (oxidation atmosphere) and of reducing the adsorbed NOx at an excessive hydrocarbon (HC) state (reduction atmosphere), is already known.

In the internal combustion engine 1, an ignition plug is provided for igniting the mixture gas of air and fuel supplied to the combustion chamber 15 from the air intake port 2. 18 is a crank angle sensor for detecting the crank angle synchronization signal θ CR from the encoder being interlocked with the camshaft, 19 is a throttle sensor for detecting the throttle valve opening degree, 20 is a water temperature sensor for detecting the cooling water temperature TW, 21 is an atmospheric pressure sensor for sensing the atmospheric pressure Pa, and 22 is an intake air temperature sensor Ta. The rotation number Ne of the internal combustion engine is calculated from the time interval of generation of the crank angle synchronization signal θ CR detected by the crank angle sensor 18. Within the car room an ECU (Electronic Control Unit) which comprises unshown input output device, memory devices (such as ROM, RAM, non-volatile RAM) storing a number of control programs, central processing unit (CPU) and timer counter, is installed and it performs a synthetic control of the air fuel ratio control device including the internal combustion engine 1. Next, description on the operation of the aforementioned apparatus will be given. The NOx occlusion catalyst 13*b* is to occlude the NOx during the lean air fuel ratio control, but because of limitations imposed on the quantity to be occluded by the catalyst for a continuous lean combustion operation, when the quantity to be occluded comes out saturated, most of the NOx (nitrogen oxide) exhausted from the internal combustion engine 1 is exhausted to the atmosphere. Then, the timing of shifting to the rich operation from the lean operation gives rise to a problem because, before the occlusion quantity of the NOx occlusion catalyst 13*b* reaches a saturated quantity, the air fuel ratio control must be shifted to the one being operated at an ideal air fuel ratio or in the vicinity of that ratio and reduction of NOx at the rich air fuel ratio or at the theoretical air fuel ratio must be started.

Generally speaking, a method of performing the rich combustion operation after performing the lean combustion operation for a predetermined interval is employed. This method is exemplified such that the ECU 23 estimates quantity of NOx exhausted from the internal combustion engine 1, and the rich operation is performed when the quantity of the exhausted NOx reaches a predetermined valve. An example of estimation of the quantity of the exhausted NOx is disclosed by the Japanese Laid-Open Patent Application No. H7-305644 such that by obtaining an estimation value DN of exhausted NOx concentration as the air fuel ratio map and obtaining a compensation coefficient KIg as the ignition timing map and also likewise obtaining K1 depending on the EGR quantity and temperature as other compensation coefficient map, quantity of the exhausted NOx QNO was obtained from the intake air quantity Qa according to the following equation (1):

$$QNO=K1\cdot KIg\cdot Qa\cdot DN \quad (1)$$

According to the Japanese Laid-Open Patent Application NO. H7-305644, though the NOx exhaust quantity QNO is estimated from the equation (1) as above, because of a fluctuation of ignition timing the relation between the air fuel ratio A/F and the NOx exhaust concentration estimation value DN and also the relation between the EGR quantity and the exhaust concentration estimation value DN heavily change. As a consequence the estimation accuracy can not be improved without obtaining the NOx exhaust concentration estimation value DN depending on the ignition timing. Also a number of maps are required resulting in having the memory capacity increased.

SUMMARY OF THE INVENTION

In order to solve the foregoing problems, the object of the present invention is to provide an air fuel ratio control apparatus for an internal combustion engine which is adapted to improve the estimation accuracy of the NOx exhaust concentration estimation value.

An air fuel ratio control apparatus for an internal combustion engine according to the invention comprises a NOx catalyst disposed in a exhaust gas passage of an internal combustion engine, a NOx exhaust quantity estimation means for estimating quantity of NOx exhausted from the internal combustion engine, an air fuel ratio control means for controlling the air fuel ratio based on the estimated NOx exhaust quantity estimated by the NOx exhaust quantity estimation means, and a NOx exhaust concentration estimation means for estimating the concentration of the exhausted NOx from at least either one of a value corresponding to said air fuel ratio or a value corresponding to recirculation quantity of an exhaust gas and a value corresponding to a ignition timing.

The NOx exhaust concentration estimation means calculates the estimated value of NOx exhaust concentration by means of the four fundamental rules of arithmetic based on at least either one of the air fuel ratio and the quantity of recirculation exhaust gas and the value corresponding to the ignition timing.

The estimated value of NOx exhaust concentration is calculated by the formula of:

$$DN=K1\ A/F+K2\ EGR,$$

wherein DN denotes the estimated value of NOx exhaust concentration, A/F denotes the air fuel ratio, EGR denotes the quantity of exhaust gas recirculation, and K1 and K2 are coefficients corresponding to the ignition timing.

The air fuel ratio control apparatus comprises a NOx exhaust quantity estimation means for estimating quantity of exhausted NOx based on the estimated value of NOx exhaust concentration and a quantity of intake air.

The air fuel ratio control apparatus comprises an ignition timing detection means, and an air fuel ratio detection means. The air fuel ratio control means comprises an exhaust gas recirculation quantity detection means. Furthermore, the air fuel ratio control apparatus comprises an exhaust gas recirculation valve opening degree detection means. The ignition timing is to be a value obtained depending on an operation state. The air fuel ratio is to be a value obtained depending on an operation state.

The exhaust gas recirculation quantity is to be a value depending on an operation state. The exhaust gas recirculation valve opening degree is to be value obtained depending on an operation state.

DESCRIPTION OF THE PREFERRED EMBODIMENT

Embodiment 1

Figure 1:
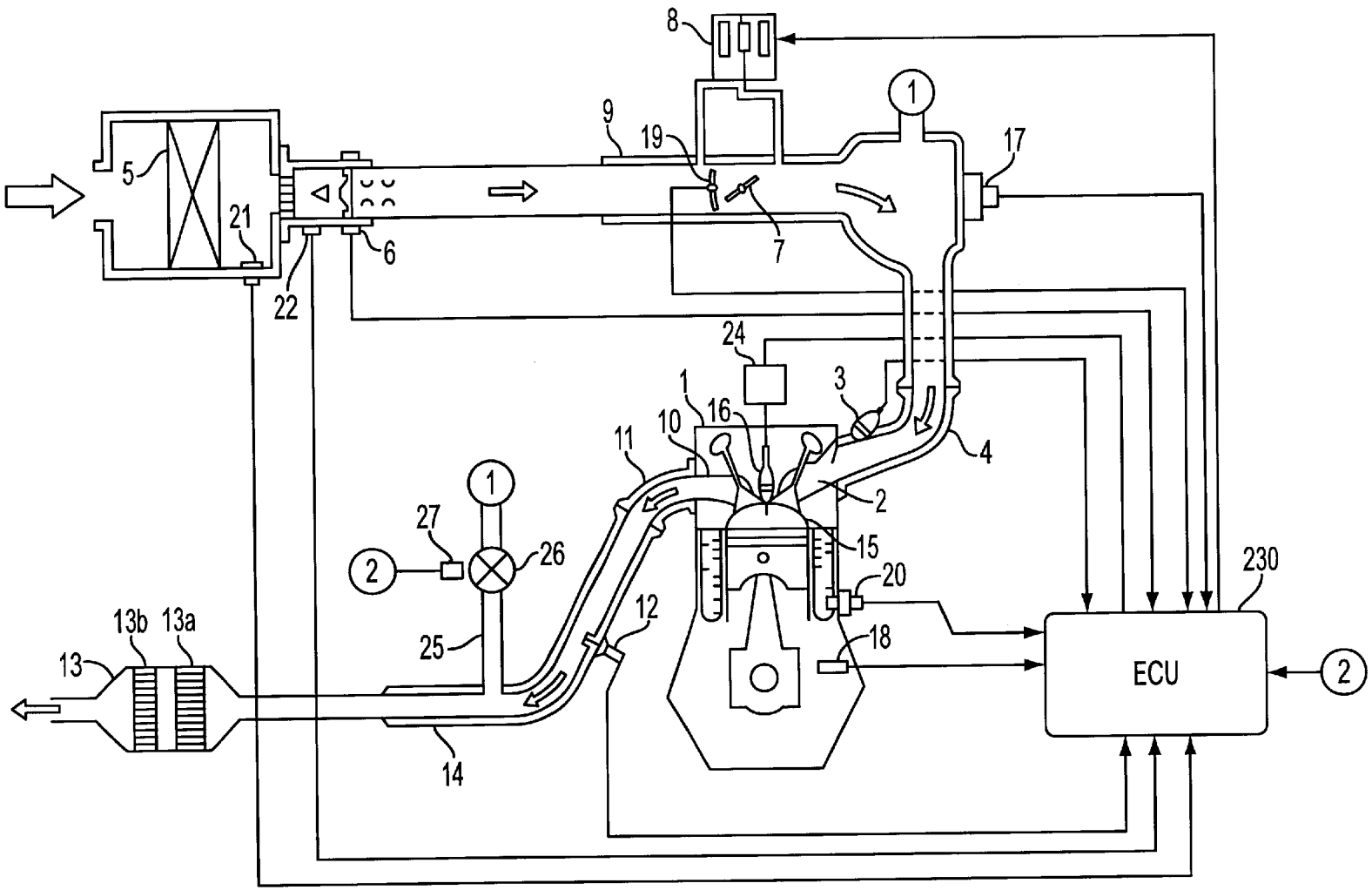
FIG. 1 is a schematic diagram according to the Embodiment 1 of the present invention.

A description will be given on the Embodiment 1 of the present invention with reference to FIG. 1~FIG. 6. FIG. 1 is a schematic diagram showing the air fuel control apparatus of the internal combustion engine 1. In FIG. 1, ECU 230 corresponds to the aforementioned ECU 23 comprising the digital computer as mentioned above and performs a synthetic control, particularly the control processing as shown by FIG. 2~FIG. 5, of the air fuel ratio control apparatus including the internal combustion engine based on a number of control programs stored in the digital computer. To the ECU 230, detection informations from various sensors such as the air flow sensor 6, the crank angle sensor 18, the throttle sensor 19, the water temperature sensor 20, the atmosphere sensor 21, and the intake air sensor 22, are inputted. The ECU 230 is adapted to output optimized values of fuel injection quantity, ignition timing, recirculation quantity of the exhaust gas EGR, etc. those of which are computed based on the detection informations from the aforementioned sensors. The ignition unit 24 outputs a high voltage to the ignition plug 16 according to the command from the ECU 230, and the ECU 230 detects this high voltage as an ignition output from the ignition unit 24.

Though not shown by a drawing, within the ECU 230 the ignition timing detection means and the exhaust gas recirculation quantity detection means are stored. The ignition timing detection means is an element which is necessary for detection of output from the ignition unit 24 to the ignition plug 16 performed by the ECU 230. The exhaust gas recirculation quantity detection means is an element for detecting the exhaust gas recirculation quantity EGR from the map which defines the relations among the rotation number Ne of the internal combustion engine, air flow sensor 6, and the atmospheric pressure sensor 21.

Though not shown by drawings, within the ECU 230, there may be means, in place of the ignition timing detection means, for obtaining ignition timing depending on the operation state, means, in place of the air fuel ratio sensor 12, for obtaining that ratio depending on the same, means, in place of the exhaust gas recirculation quantity detection means, for obtaining that quantity depending on the same and means, in place of the valve position sensor 27, for the opening degree of the exhaust gas recirculation valve depending on the same may be stored.

The means for obtaining the ignition timing on the operation state can be put to operation in such a way that the ECU 230 previously memorizes the map consisting of the intake air quantity Qa or the internal combustion engine load P and the rotation number Ne of the internal combustion engine, and obtains the ignition timing from the aforementioned ignition timing map based on the detection signal from the air flow sensor 6 or the load P, which is a parameter representing the internal combustion engine load such as filling efficiency, and the detection signal from the crank angle sensor 18.

Likewise, the means obtaining the air fuel ratio depending on the operation state, the means for obtaining the exhaust gas recirculation quantity depending on the same and the means for obtaining operating degree of the exhaust gas recirculation valve depending on the same can be established by exchanging wordings of "ignition timing" by "air fuel ratio", "the opening degree of the exhaust gas recirculation" and "the exhaust gas recirculation quantity", respectively appearing in the passage of "the ECU 230 previously memorizes the map consisting of the intake air quantity Qa or the internal combustion engine load P and the rotation number Ne of the internal combustion engine, and obtains the ignition timing from the aforementioned ignition timing map based on the detection signal from the air flow sensor 6 or the load P being a parameter representing the internal combustion engine such as filling efficiency and the detection signal from the crank angle sensor 18."

Figure 8:
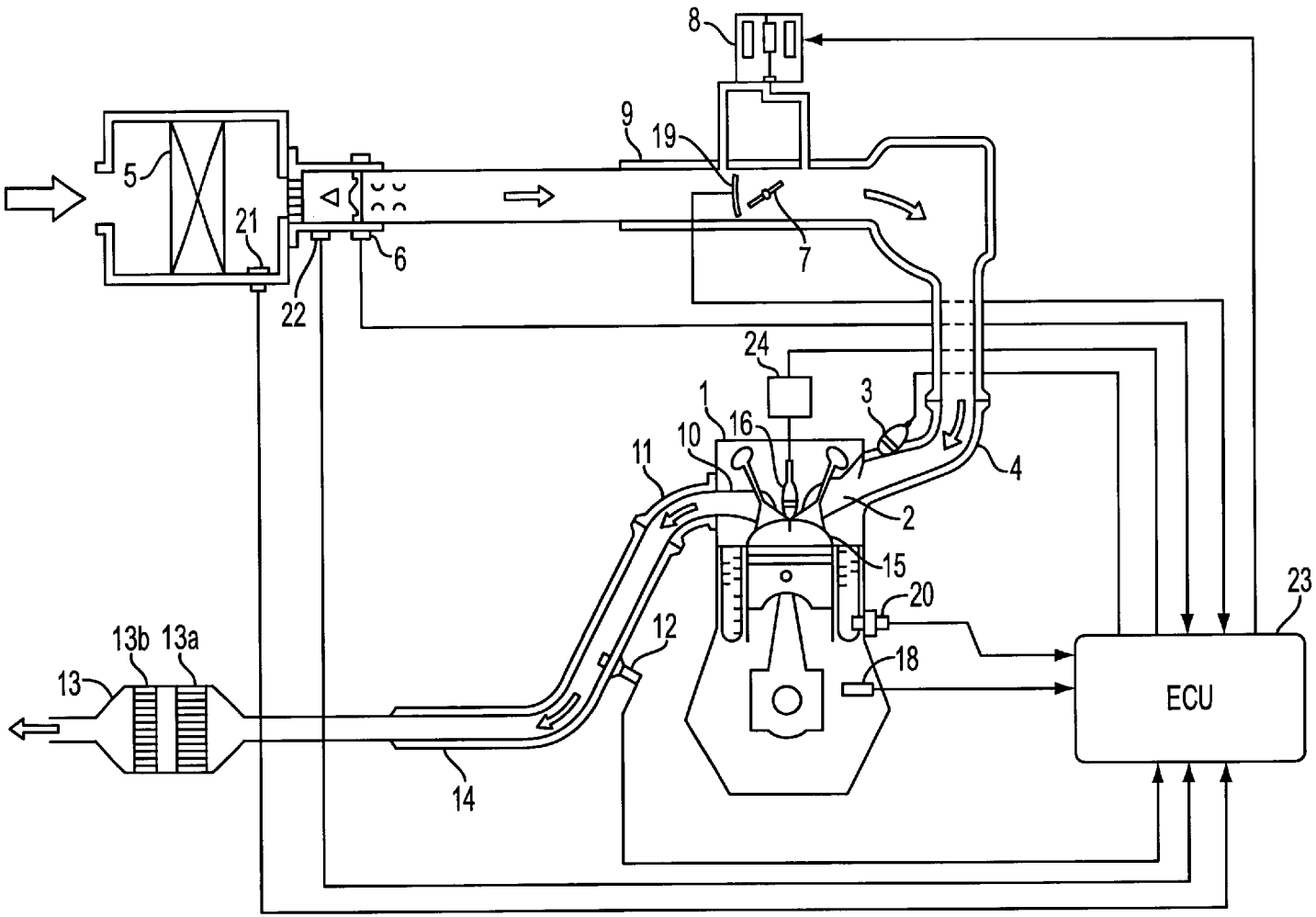
FIG. 8 (PRIOR ART)
FIG. 8 is a schematic diagram of a conventional air fuel ratio control apparatus for an internal combustion engine.

In the manifold 4 an intake air pressure sensor 17 for detecting the intake air pressure Pb is disposed. An exhaust gas recirculation pipe 25 is connected to the exhaust pipe 14 and to the air intake manifold 4, an exhaust gas recirculation valve 26 for opening and closing the recirculation pipe 25 is disposed at an intermediate position of the exhaust gas recirculation pipe 25 and a valve position sensor for detecting the opening degree of the exhaust gas recirculation valve is provided to the exhaust gas recirculation valve 26. The connecting element marked as ① the one marked as ②, respectively are mutually connected. Components such as the internal combustion engine 1, the air intake port 2, the fuel injection valve 3, the air intake manifold 4, the air cleaner 5, the air flow sensor 6, the throttle valve 7, the ISC valve 8, the air intake pipe 9, the exhaust port 10, the exhaust manifold 11, the air fuel ratio sensor 12, the exhaust gas purification device 13, the ternary catalyst 13*a*, the NOx occlusion catalyst 13*b*, the exhaust pipe 14, the combustion chamber 15, the ignition plug 16, the crank angle sensor 22, the ignition unit 24, and means for computing the rotation number Ne of the internal combustion engine from the time interval of the crank angle synchronization signal θ CR are the same as the previous FIG. 8.

Figure 2:
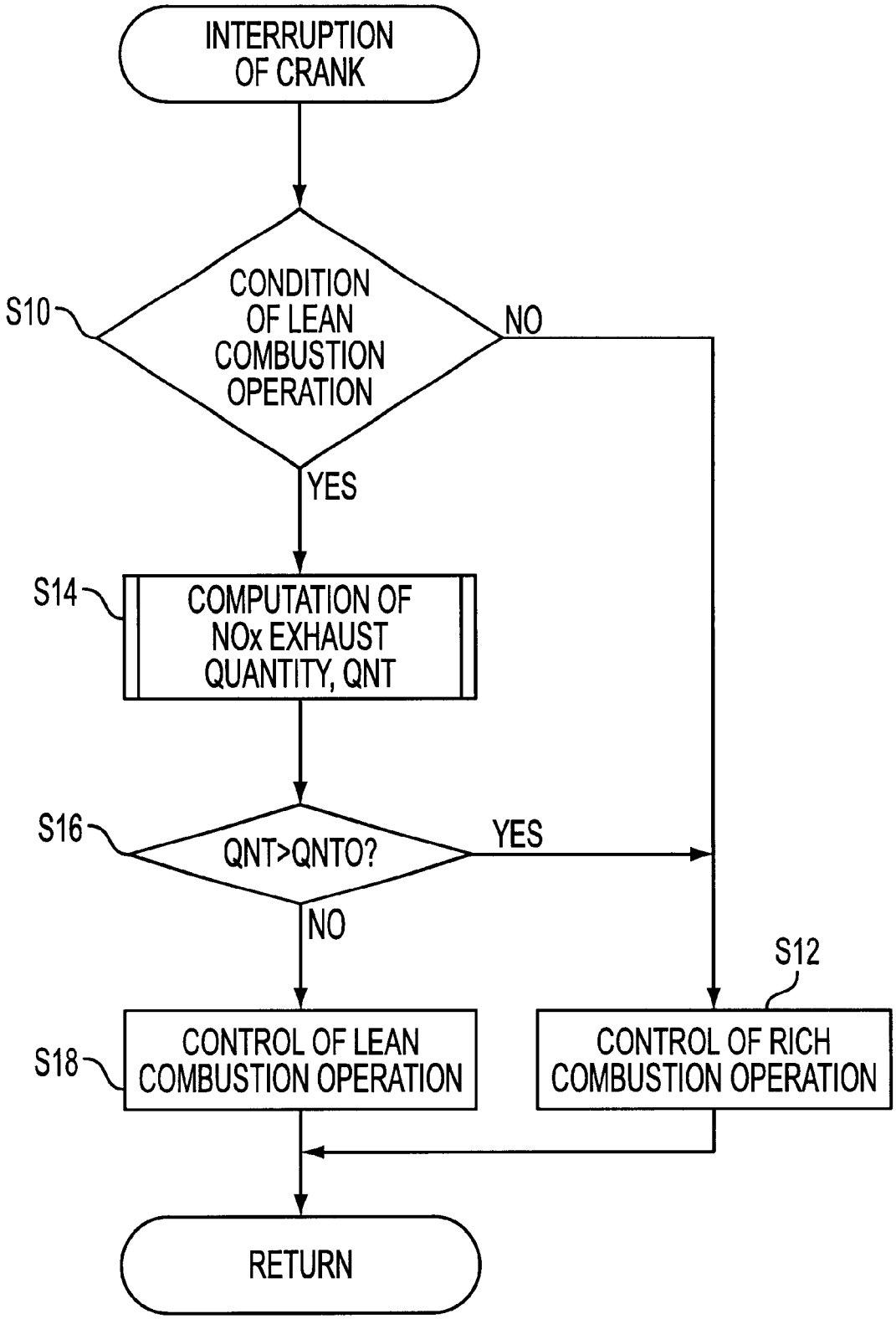
FIG. 2 is a flow chart for the air fuel ratio control according to the Embodiment 1 of the present invention.

Subsequently, a description on the operation of the Embodiment 1 will be given. FIG. 2 is a flow chart showing the air fuel ratio control performed by the ECU, and this control is performed every generation of the crank angle synchronization signal θ CR (e.g, every 120° of the crank angle) supplied from the crank angle sensor 18 by interruption. This air fuel ratio control shifts the operation to the rich combustion operation when the NOx occlusion capability of the NOx occlusion catalyst 13*b* reaches a saturated state during the lean combustion, which is an oxidation state, operation, and thus putting the NOx occlusion catalyst 13 under the ambient atmosphere of reduction entaling restoration of the occlusion capability of the NOx occlusion catalyst 13*b* for a predetermined interval and repition of this control follows. The lean combustion operation is to drive the internal combustion engine 1 by burning a thin fuel mixture gas whose air fuel ratio is larger than the theoretical air fuel ratio (14.7) by increasing the intake air quantity by opening the throttle valve 7 and the ISC valve 8 or closing the throttle valve 7 and opening the ISC valve 8 only with the fuel injection quantity from the fuel injection valve 3 being kept to be constant. The rich combustion operation is to drive the internal combustion engine by burning a mixture gas having an air fuel ratio smaller than the value of the theoretical air fuel ratio (14.7) and the exhaust gas under the rich combustion operation contains larger amount of HC and CO than under the lean combustion operation. Thus, the exhausted gas under the rich combustion operation is a reduction atmosphere and hence enabling the reduction of NOx.

At first, the ECU 230 judges whether the condition of the lean combustion operation is established or not at the Step 10. The condition for the lean combustion operation is such that the internal combustion engine 1 is performing a warming up drive, is being driven within a predetermined operation range, which is defined depending on the rotation number Ne of the internal combustion engine and the engine load, and is not being accelerated or is not to be accelerated.

If the result of the judgement at the Step 10 is NO (denial) such that the condition for the lean combustion operation is not established, the operation proceeds to the Step 12 and the rich combustion control is performed. On the other hand, if the result of the judgement at the Step 10 is Yes (affirmative) the operation proceeds to the Step 14 and the computation of the exhausted quantity of the NOx is computed.

Figure 3:
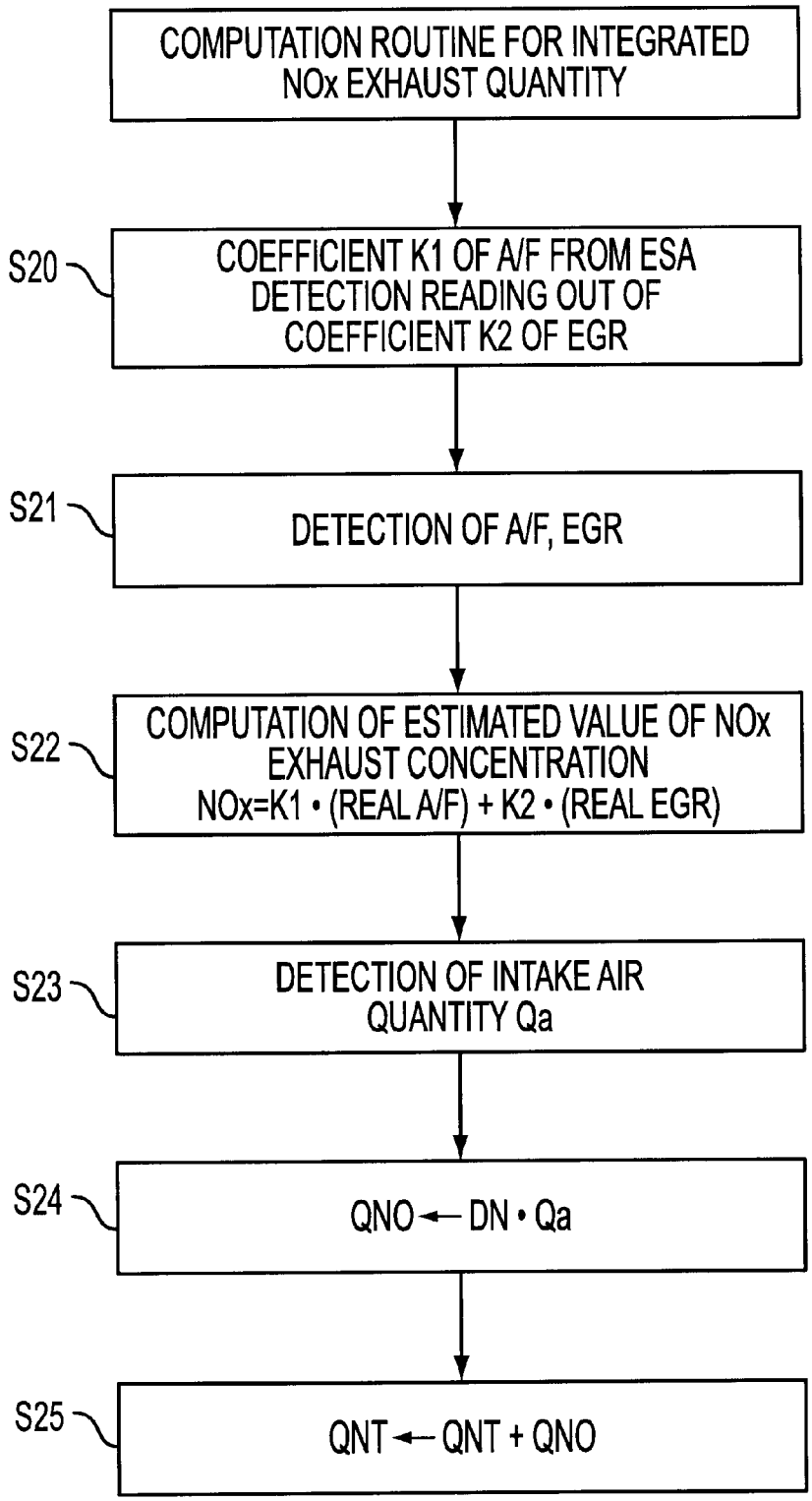
FIG. 3 is a flow chart for the estimation of the NOx exhaust quantity according to the Embodiment 1 of the present invention.

FIG. 3 is a flow chart showing a procedure of computation of the NOx exhaust quantity when the ECU 230 performs the function as the NOx exhaust quantity estimation means. Subsequently, based on FIG. 3, the procedure of computation of the NOx exhaust quantity will be described. The ECU 230 reads the computation value of the concentration of the NOx exhausted by the internal combustion engine using a memorized formula. This reading value is not the value actually detected but is obtained by reading a computed value through a formula established by a previously performed experiment. Consequently, this value is dealt with as an estimation value.

Figure 5:
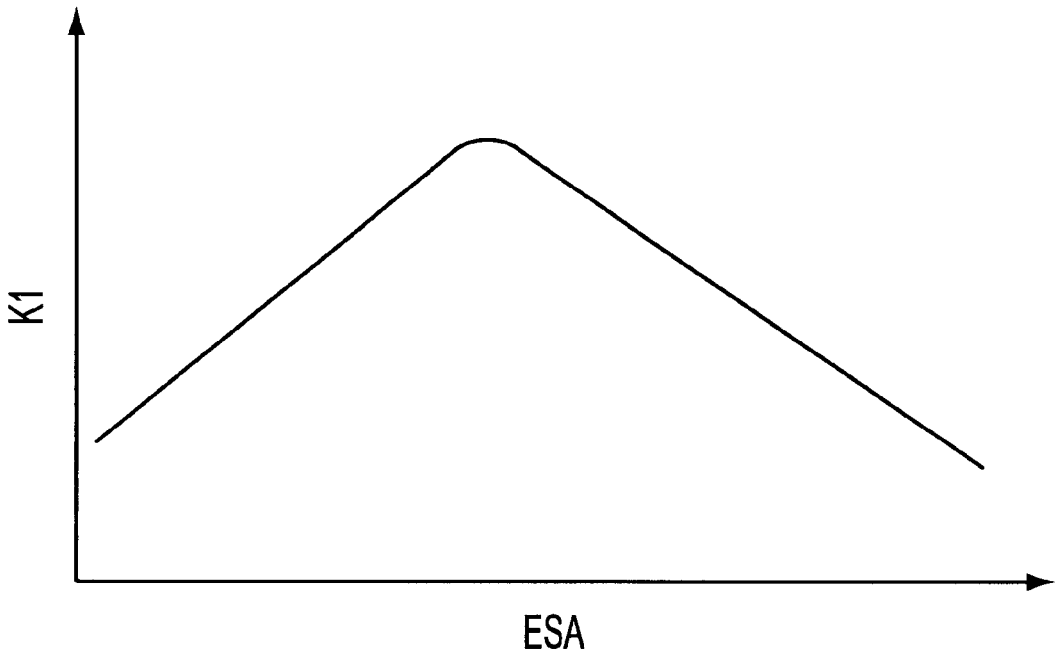
FIG. 5 shows a map of K1 with respect to the ignition timing according to the Embodiment 1 of the present invention.
Figure 6:
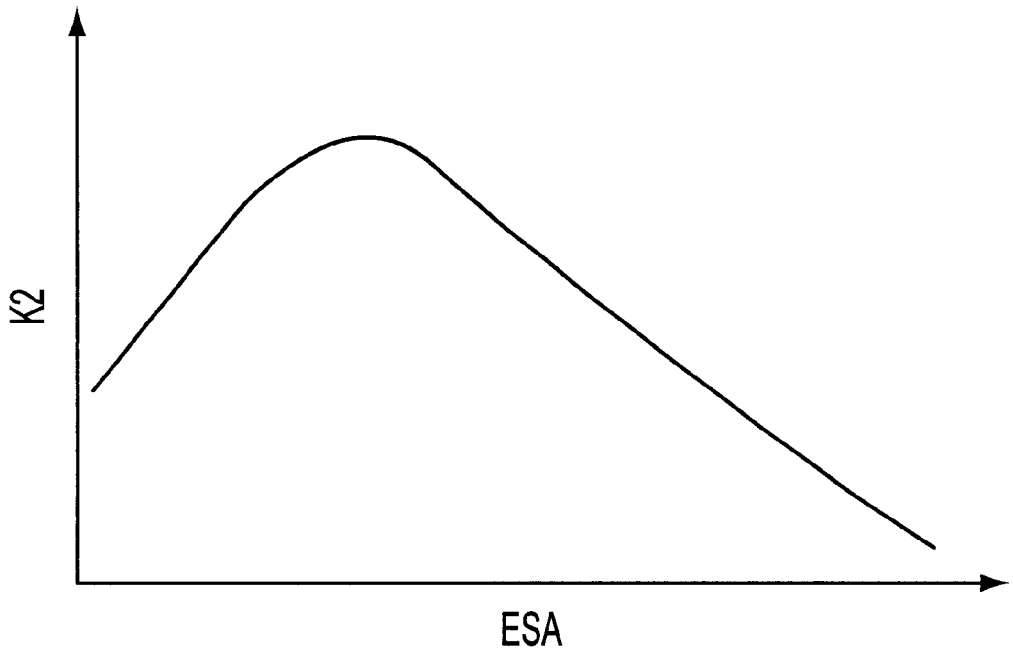
FIG. 6 shows a map of K2 with respect to the ignition timing according to the Embodiment 1 of the present invention.

At first by detecting the ignition timing detection value ESA at the Step 20, the coefficient K1 of the air fuel ratio A/F and the coefficient K2 of the exhaust gas recirculation quantity EGR are read out from respective maps. FIG. 5 shows the map for K1 and FIG. 6 shows the map for K2. Next, at the Step 21 the air fuel ratio A/F and the exhaust gas recirculation quantity EGR are detected and at the Step 22 the NOx exhaust concentration estimation value DN is obtained. This NOx exhaust concentration estimation value DN is expressed by the following formula (2) with respect to the respective ignition timing detection value ESA:

$$DN=K1(real\ A/F)+K2(real\ EGR) \tag{2}$$

Where, K1 and K2 change depending on the ignition timing value. The real A/F denotes that ratio inputted from the sensor 12, and the real EGR is the value obtained from the map.

At the Step 23 the intake air quantity Qa is detected. At the Step 24 the NOx exhaust quantity QNO is computed using the NOx exhaust concentration estimation value DN and the intake air quantity Qa through the following formula (3):

$$QNO=Qa\cdot DN \tag{3}$$

At the step 25 an integrated value of the NOx exhaust quantity QNO, i.e. an integrated NOx exhaust quantity, QNT is computed by the formula (4):

$$QNT=\int QNOdt \tag{4}$$

In view of program, this formula (4) is expressed to be QNT←QNT+QNO

When the integrated value of the NOx exhaust quantity, QNT is computed in aforementioned manner, the Step 16, in which the ECU 230 in FIG. 2 functions as a comparator, is performed, and at the Step 16 whether the integrated NOx exhaust quantity, QNT is larger than a predetermined value QNTO or not is judged. The QNTO is a value such that it is the same as or less than, for example, the occlusion capacity of the NOx occlusion catalyst 13*b*. If resultant judgement is NO (denial), it is judged that there is a margin in the NOx occlusion capacity of the NOx occlusion catalyst 13*b*, then advancing to the Step 18 the lean combustion control is performed.

On the other hand, if the resultant judgement of the Step 16 is Yes (affirmative) and also if the integrated NOx exhaust occlusion value QNT is larger than the predetermined QNTO, the occlusion capacity of the NOx occlusion catalyst 13*b* is supposed to be saturated. Then advancing to the aforementioned Step 12 and supplying the rich combustion operation signal and the rich combustion operation control is performed. In this way by shifting to the rich combustion operation at the time when the integrated NOx exhaust quantity QNT exceeds the predetermined QNTO, the exhaust quantity of HC and CO from the internal combustion engine 1 is increased and the oxygen deficient state is created; then causing reaction of HC and CO on NOx, the NOx occluded in the NOx occlusion catalyst 13*b* can be reduced and the reduced NOx can be exhausted to the atmosphere. By virtue of the process as above, the NOx occlusion catalyst 13*b* is allowed to reocclude the NOx. According to the judgement at the Step 16, the rich combustion operation at the Step 12 is performed and simultaneously with starting reduction of the NOx occluded in the NOx occlusion catalyst 13*b*, the timer counter of the ECU 230 starts the clocking. After the rich combustion operation is started, the foregoing routine is repeated.

Figure 4:
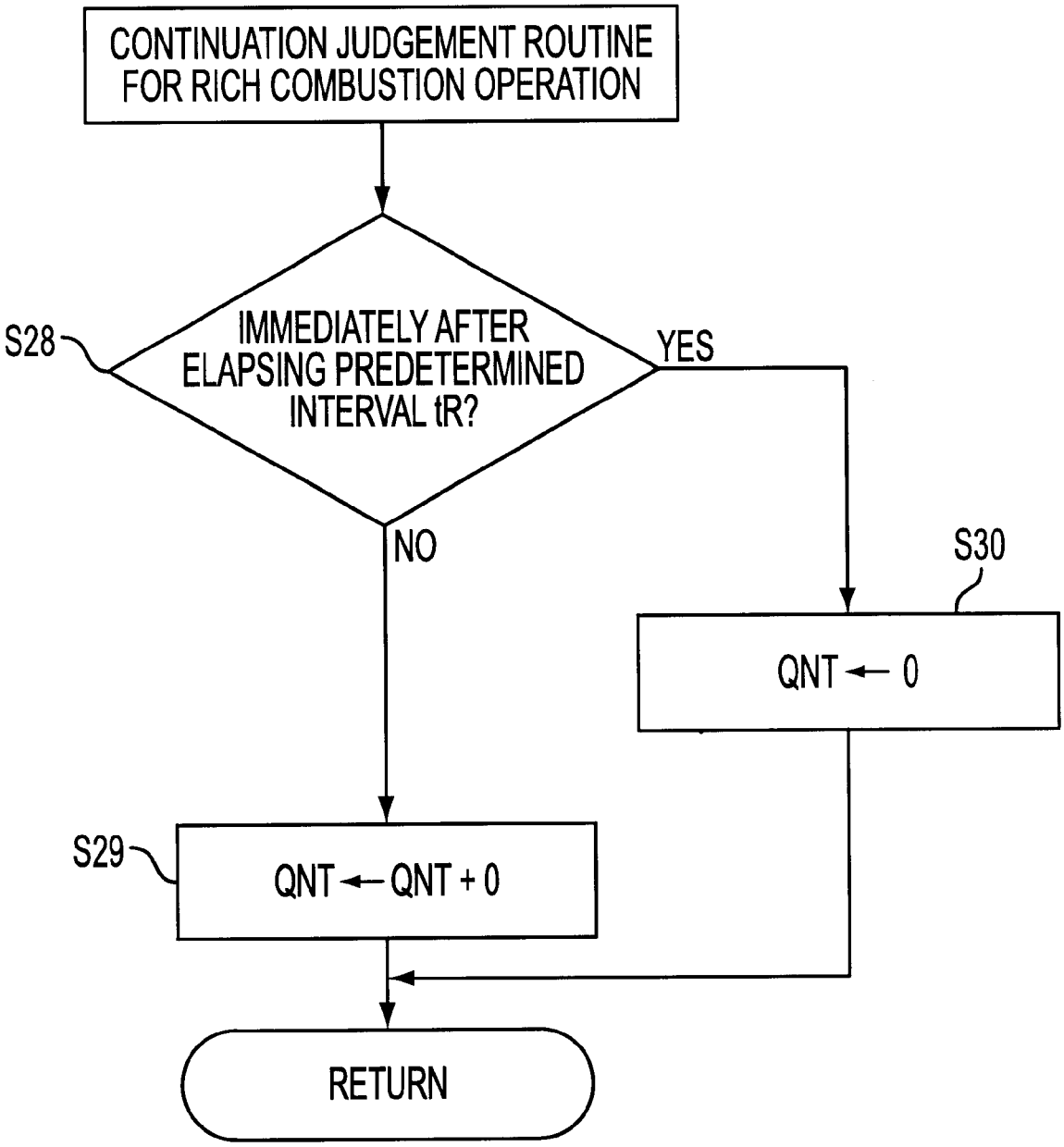
FIG. 4 is a flow chart for judgement of continuation of the rich combustion operation according to the Embodiment 1 of the present invention.

FIG. 4 is a flow chart showing the procedure for judgement of continuation of the rich combustion operation when the ECU 230 functions as a means for judgement of the same. After starting clocking of the timer counter of the ECU 230, the process as shown by FIG. 4 is started; when the resultant judgement at the Step 28 is NO (denial), the foregoing clock time is supposed not to elapse a predetermined interval tR (e.g. three seconds) during which reduction of the NOx is deemed to be completed and consequently advancing to the Step 29 and the process is updated by counting up zero to the integrated NOx exhaust quantity QNT. At this time, value of the integrated NOx exhaust quantity QNT is held at a value larger than a predetermined QNTO. Therefore the resultant judgement at the Step 16 in FIG. 2 supports Yes (affirmation) and the rich combustion operation is continued resulting in a sufficient reduction of the NOx.

After the predetermined interval tR (three seconds) is lapsed after starting of the rich combustion operation, the resultant judgement at the Step 28 in FIG. 4 becomes Yes (affirmative) and advances to Step S30. At the Step 30, the NOx is deemed to be completely reduced from the NOx occlusion catalyst because of elapse of the predetermined time tR (three seconds) and the integrated value of the NOx exhaust quantity QNT is reset to zero.

To sum up, when the integrated value of the NOx exhaust quantity QNT reaches the predetermined value QNTO, the operation state is shifted from the lean combustion operation to the rich combustion operation and the rich combustion operation is to be held for the predetermined time tR. By virtue of this process the NOx occluded in the NOx occlusion catalyst 13*b* is completely reduced and when the lean combustion operation is started after elapse of the predetermined time (three seconds), the NOx is put in a condition where the NOx occlusion capacity is restored. By performing a sustained continuous lean combustion operation, when the operation is performed under a condition of small NOx exhaust quantity, the frequency of shift to the rich operation can be reduced so that degradation of the fuel consumption behavior and the torque fluctuation can be suppressed to the utmost.

Embodiment 2

Figure 7:
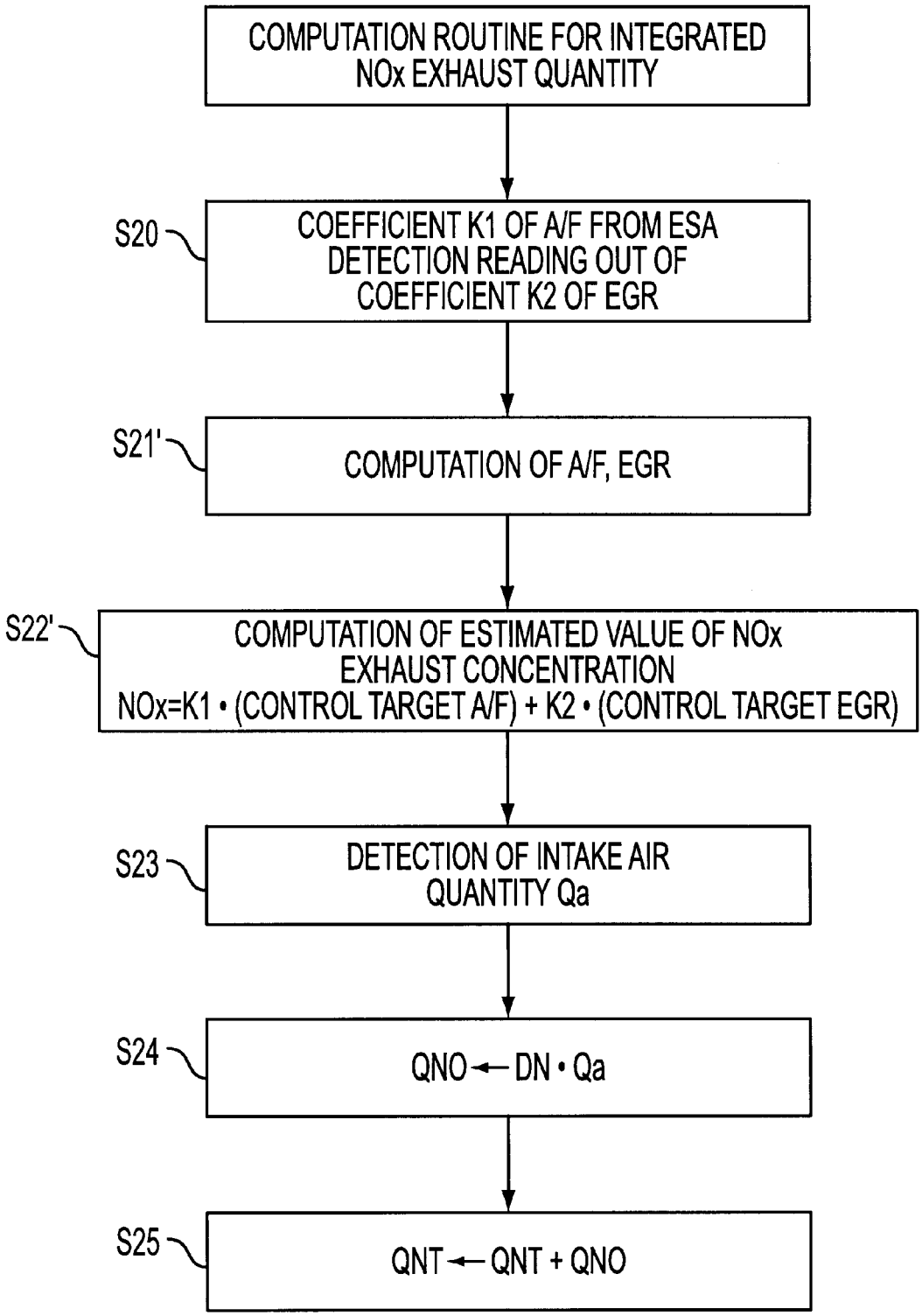
FIG. 7 is a flow chart for the estimation of the NOx exhaust quantity according to the Embodiment 2 of the present invention.

Though in the Embodiment 1 , A/F and EGR are detected and the NOx exhaust concentration estimation value DN was obtained using the real A/F and the real EGR, as shown by FIG. 7, the NOx exhaust concentration estimation value DN can be obtained by using, in place of the real A/F and the real EGR, the control target A/F and the control target EGR. FIG. 7 is a flow chart showing computing process of the integrated value of the NOx exhaust quantity QNT according to the Embodiment 2 of the present invention, and FIG. 7 is the same as FIG. 3 except for changing from Step 21 and Step 23 to corresponding Step 21' and Step 22', respectively in FIG. 7. At the Step 21' the control target A/F is computed from the computed value of the air fuel ratio and the target control EGR is computed from the control target EGR step number. At the Step 22' the NOx exhaust concentration DN is obtained by substituting the above control target A/F and the control target EGR into the formula (5):

$$DN=K1\cdot(control\ target\ A/F)+K2\cdot(control\ target\ EGR) \quad (5)$$

As mentioned above, the air fuel ratio control apparatus for an internal combustion engine according to the present invention, by estimating the NOx exhaust concentration from a value depending on the ignition timing and at least either one of a value depending on the air fuel ratio and a value depending on the exhaust gas recirculation quantity, accuracy of the estimation of the NOx exhaust concentration can be improved and in turn the estimation accuracy of the NOx exhaust quantity can be improved.

Also because of obtaining the NOx exhaust concentration by means of the four fundamental rules of the arithmetics, number of maps is decreased and thus memory capacity can be reduced.

What is claimed is:

1. An air fuel ratio control apparatus for an internal combustion engine comprising:

a NOx catalyst disposed in a exhaust gas passage of internal combustion engine, a NOx exhaust quantity estimation means for estimating quantity of NOx exhausted from said internal combustion engine, an air fuel ratio control means for controlling said air fuel ratio based on said estimated NOx exhaust quantity estimated by said NOx exhaust quantity estimation means, and a NOx exhaust concentration estimation means for estimating said concentration of said exhausted NOx from a value depending on an ignition timing and at least either one of a value depending on the air fuel ratio and a value depending on an exhaust gas recirculation quantity.

2. An air fuel ratio control apparatus for an internal combustion engine according to claim 1, wherein said NOx exhaust concentration estimation means calculates said estimated value of NOx exhaust concentration by means of four fundamental rules of arithmetics based on said value depending on said ignition timing and at least either one of said value depending on the air fuel ratio and said value depending on the exhaust gas recirculation quantity.

3. An air fuel ratio control apparatus for an internal combustion engine according to claim 2, wherein said estimated value of NOx exhaust concentration is calculated by the formula of:

$$DN=K1\cdot A/F+K2\cdot EGR,$$

where, DN denotes the estimated value of NOx exhaust concentration, A/F denotes the air fuel ratio, EGR denotes the quantity of exhaust gas recirculation, and K1 and K2 are coefficients depending on the ignition timing.

4. An air fuel ratio control apparatus for an internal combustion engine according to claim 1, wherein said air fuel ratio control apparatus comprises a NOx exhaust quantity estimation means for estimating said NOx exhaust quantity based on said estimated value of NOx exhaust concentration and a quantity of intake air.

5. An air fuel ratio control apparatus for an internal combustion engine according to claim 1, wherein said air fuel ratio control apparatus comprises an ignition timing detection means.

6. An air fuel ratio control apparatus for an internal combustion engine according to claim 1, wherein said air fuel ratio control apparatus comprises an air fuel ratio detection means.

7. An air fuel ratio control apparatus for an internal combustion engine according to claim 1, wherein said air fuel ratio control means comprises an exhaust gas recirculation quantity detection means.

8. An air fuel ratio control apparatus for an internal combustion engine according to claim 1, wherein said air fuel ratio control apparatus comprises an exhaust gas recirculation valve opening degree detection means.

9. An air fuel ratio control apparatus for an internal combustion engine according to claim 1, wherein said ignition timing is to be a value obtained depending on an operation state.

10. An air fuel ratio control apparatus for an internal combustion engine according to claim 1, wherein said air fuel ratio is to be a value obtained depending on an operation state.

11. An air fuel ratio control apparatus for an internal combustion engine according to claim 1, wherein said exhaust gas recirculation quantity is to be a value obtained depending on an operation state.

12. An air fuel ratio control apparatus for an internal combustion engine according to claim 8, wherein an exhaust gas recirculation valve opening degree determined from said exhaust gas recirculation valve opening degree detection means is to be a value obtained depending on an operation state.

* * * * *